US005848631A

United States Patent [19]

DeGiovanni et al.

[11] Patent Number: 5,848,631

[45] Date of Patent: Dec. 15, 1998

[54] MOVABLE CLOSURE WITH LOAD RESISTANT LATERAL LOCKS

[75] Inventors: Felice P. DeGiovanni, Middle Village; Sebastian Magro, Stony Brook, both of N.Y.

[73] Assignee: Alpine Overhead Doors, Inc., Brooklyn, N.Y.

[21] Appl. No.: 810,045

[22] Filed: Mar. 4, 1997

[51] Int. Cl.[6] ..... E06B 9/08

[52] U.S. Cl. ..... 160/133; 160/269; 160/273.1

[58] Field of Search ..... 160/133, 269, 160/209, 273.1

[56] References Cited

U.S. PATENT DOCUMENTS

| | | | |
|---|---|---|---|
| 802,185 | 10/1905 | Folden | 160/269 X |
| 1,676,327 | 7/1928 | Faulds | 160/269 |
| 1,713,989 | 5/1929 | Warnick | 160/269 |
| 1,751,950 | 3/1930 | Sacerdote | 160/269 |
| 1,756,496 | 4/1930 | Warnick | 160/269 |
| 2,870,831 | 1/1959 | Peselnick | 160/269 X |
| 3,237,682 | 3/1966 | Davis | 160/133 X |

*Primary Examiner*—Blair Johnson
*Attorney, Agent, or Firm*—Lackenbach Siegel Marzullo Aronson & Greenspan, P.C.

[57] ABSTRACT

An Overhead rolling gate for a generally rectangular opening in a wall includes a generally horizontal frame portion at the top of the rectangular opening and two generally vertical portions at the lateral sides of the rectangular opening. A shaft is mounted substantially along the horizontal frame portion for rotation about a horizontal axis. A closure member is provided which has a length at least equal to the height of the rectangular opening and is capable of beg rolled up onto said shaft or spindle when in an open condition of the overhead gate and rolled down from the shaft or spindle to a closed position of the overhead gate to cover the rectangular opening. The closure member has a width selected to insure that the lateral ends of the closure member are guided by the vertical frame portions when the closure is rolled up unto or rolled down from the shaft or spindle. Locking means selectively locks and fixes the lateral ends of the closure member relative to the vertical portions when the closure member is closed up to anticipated wind loads of approximately 103 pounds per square foot. In this way the closure member acts as a beam fixed at both lateral ends thereby minimizing the maximum deflection relative to a plane defined by the wall or frame as a result of distributed anticipated wind loads acting on the closure member.

20 Claims, 9 Drawing Sheets

FIG. 1
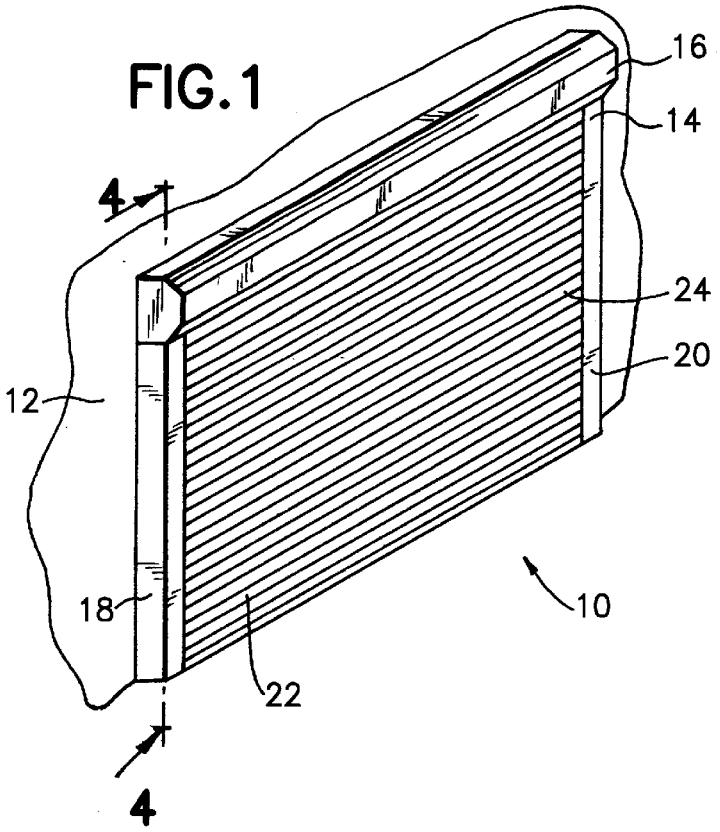
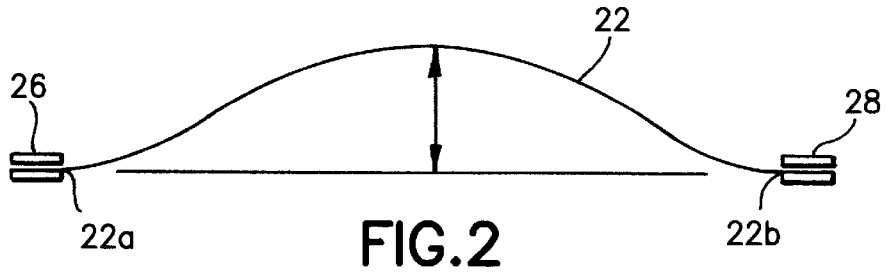
FIG. 2
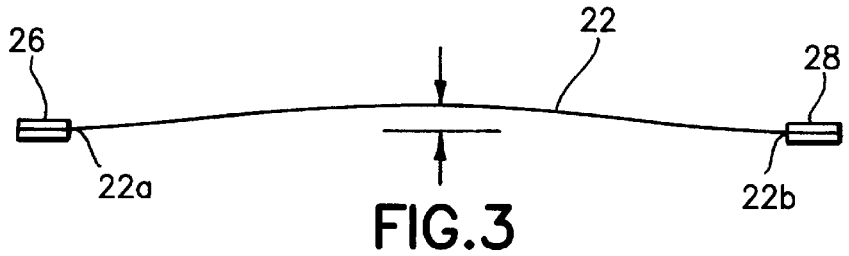
FIG. 3

FIG. 4
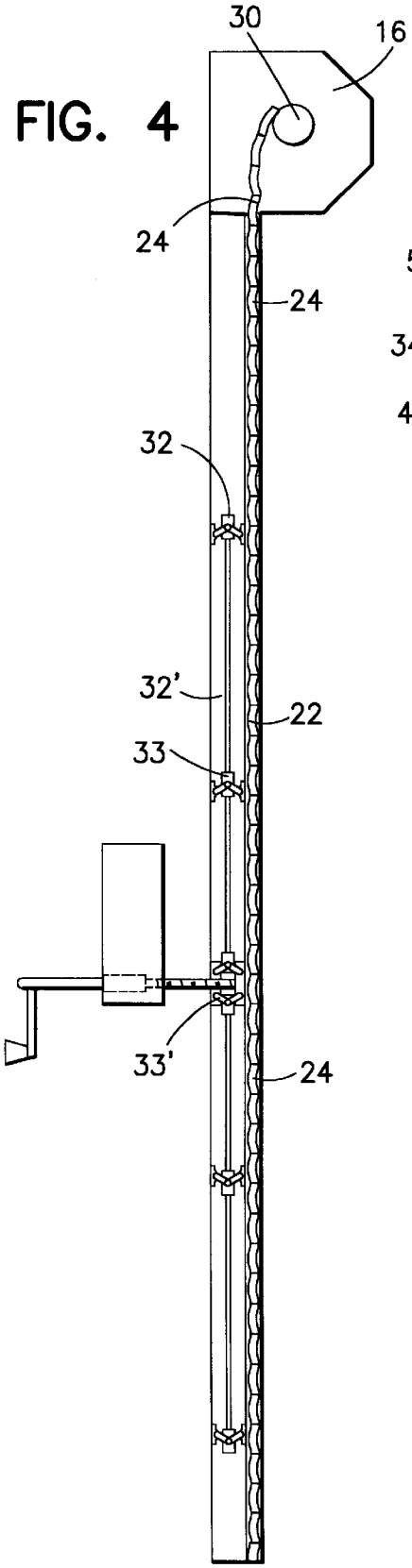
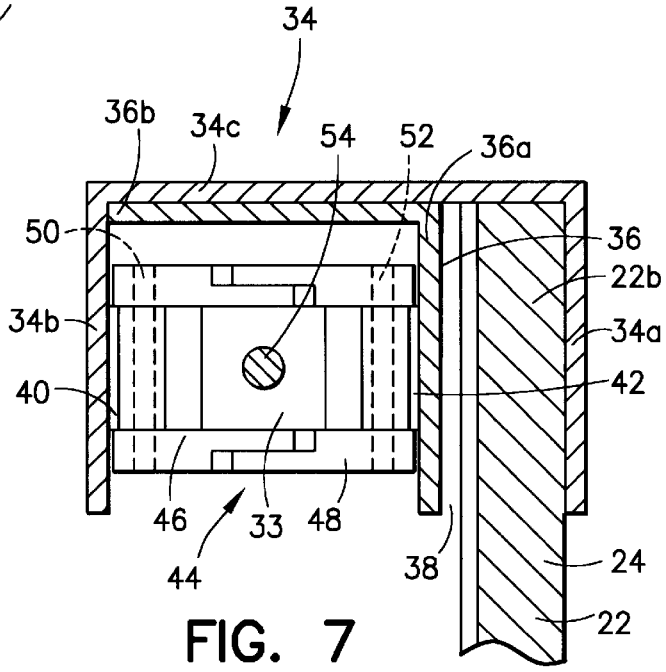
FIG. 7
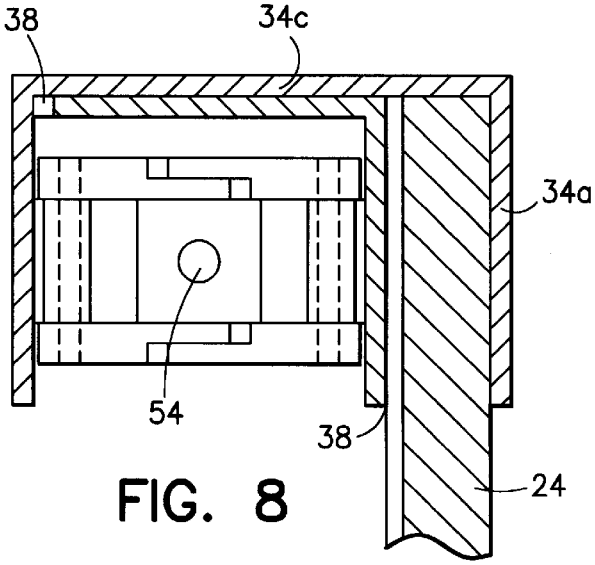
FIG. 8

FIG. 9
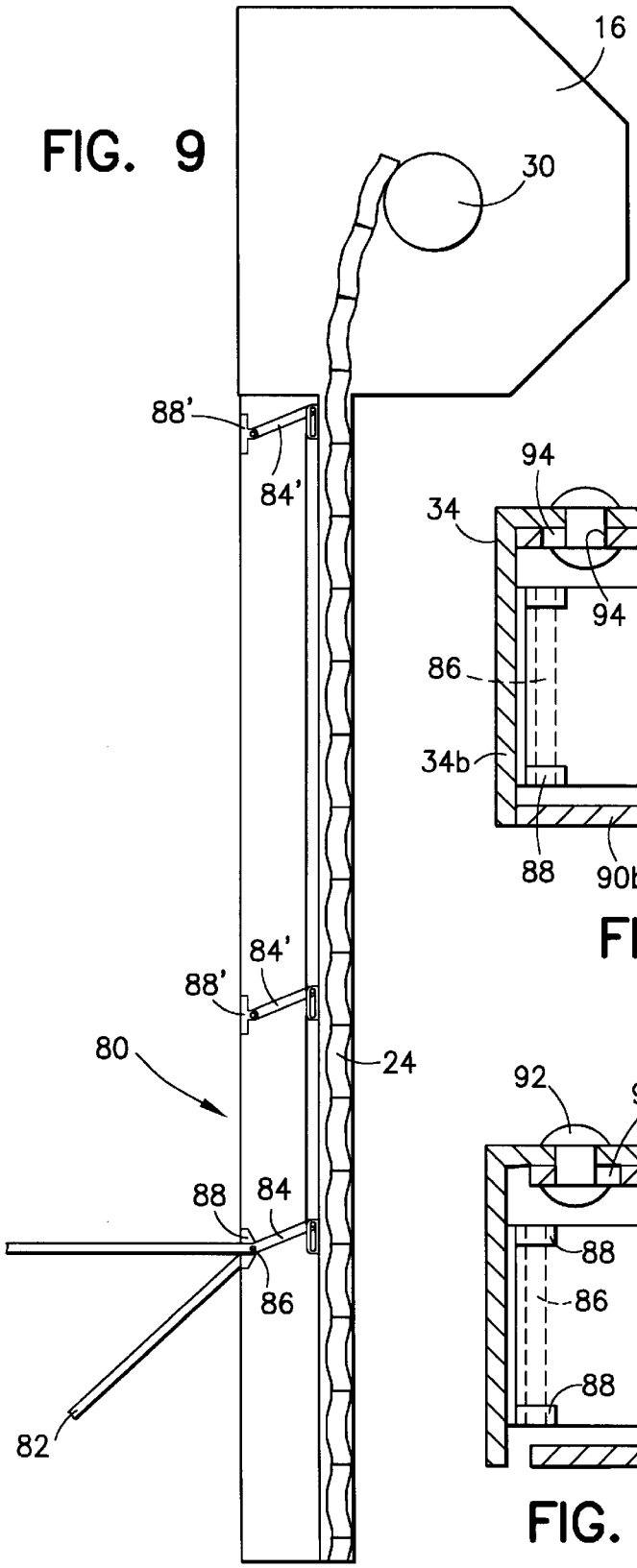
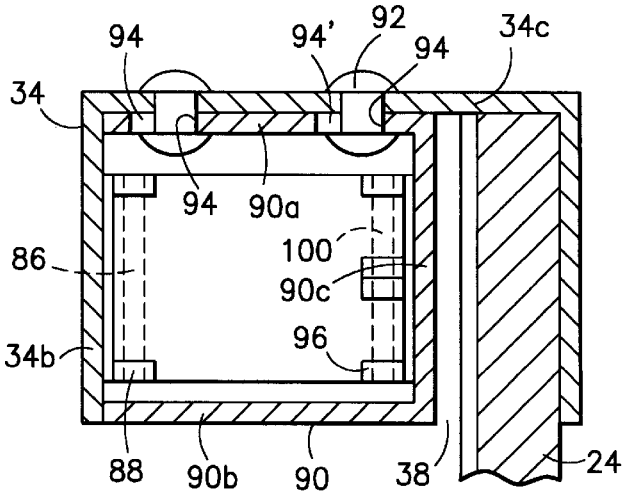
FIG. 12
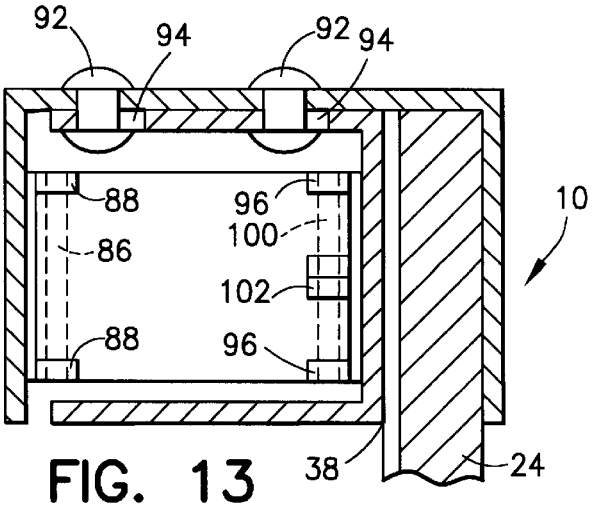
FIG. 13

MOVABLE CLOSURE WITH LOAD RESISTANT LATERAL LOCKS

BACKGROUND OF THE INVENTION

1. Field of the Invention

The present invention generally relates to movable closures including overhead rolling gates, such as doors and/or windows, and, more specifically, to movable closures with load resistant lateral locks.

2. Background of the Invention

Closure devices for protecting openings in building structures, such as doors and windows, are frequently relied upon not only to provide security for the building structure by preventing unauthorized access to the structure, but are frequently also relied upon to protect the structure from severe natural climatic conditions. To the extent that doors and windows are made of glass, these are particularly susceptible to certain climatic conditions, in particular hurricanes, cyclones and tornadoes. Glass which is frequently used to close openings in building structures are not only susceptible to being destroyed by flying debris during such adverse climatic conditions, but can also be destroyed as a result of dynamic and/or static air pressure differentials on the two sides of the windows, doors or the like. As a result of the dangers posed by these naturals climatic conditions, a number of States and local governments have enacted rules and regulations in order to prevent or minimize damage. The State of Florida, for example, has enacted such regulations and building codes due to the frequent occurrences of hurricanes in a number of counties in Florida, such as Dade and Broward counties.

One approach to ameliorate the problem has been to use shutters which are hingedly mounted on each side of the opening of the structure. However, such shutters, to be effective, have been made of heavy materials such as steel, are not conducive for automatic operation and are relatively expensive. Rolling, slatted doors and shades have also been used. These are typically rolled up in a coil at the top of the opening and unrolled to cover the entire opening exteriorly of the glass windows and doors. While such rolling closures have been effective to prevent impact by flying debris, they typically flex or bend when subjected to positive or negative pressures on the outside of the structure. However, such bending or flexing of the slats outside of the plane of the building structure effectively shortens the lengths of these slats by moving the ends inwardly, particularly on the sides and on the bottom of the door. While some known designs have attempted to limit the lateral inward movements of the ends of the slats to thereby prevent excessive bowing or flexing of the slats outside the plane of the rolling closure, these have not prevented excessive upward deflection of the lowermost slat due to the cumulative flexing of the intermediate slats, particularly at the central region or at points of the closure slats most remote from the lateral or anchored points. Such bending or flexing, therefore, creates an opening at the bottom of the slatted closure. This opening, if excessive, can be sufficient to create positive or negative pressure conditions between the slatted closure and the glass components of the window or door. Unless such bending or flexing is controlled, therefore, damage can still be caused by a severe hurricane, tornado or the like. Other relatively flexible closures are required to withstand distributed loads. For example, pool covers and shutters for inclined or horizontal windows or roofs are required to support considerable snow loads. With such closures it is also desirable to minimize the amount of flexing of the closures when the loads are applied.

SUMMARY OF THE INVENTION

It is, accordingly, an object of the present invention to provide a load-resistant closure device which does not have the disadvantages inherent in the prior art closure devices.

It is another object of the present invention to provide a load-resistant closure for doors, windows and other openings which is simple in construction and economical to manufacture.

It is still another object of the present invention to provide a load-resistant closure device which is easy to use and can be automated in its operation for opening or closing the same.

It is yet another object of the present invention to provide a load-resistant closure device which can protect openings in building structures, such as windows and doors, under extreme wind, positive or negative pressure conditions, or snow loads.

It is a further object of the present invention to provide a wind-resistant overhead door which conforms with the codes of various States or local governments, such as those established by the South Florida Building Code, 1994 Edition, and Broward County, 1994 Edition.

It is still a further object of the present invention to provide a wind-resistant closure which can be used both with vertical doors and windows, and inclined or horizontal load bearing closures, such as flat roofs or pool covers.

It is yet a further object of the present invention to provide a wind-resistant closure, in the form of roll down closure, which prevents or minimizes lateral openings, on both sides of the closure as well as a bottom opening at the bottom of the closure.

It is an additional object of the present invention to provide a load-resistant overhead closure which achieves the above objects and which minimizes inward bending or flexing of the closure by locking its lateral ends or edges.

It is yet an additional object of the present invention to provide a load-resistant closure mechanism which can be used with windows, doors and other openings having a wide range of widths.

In order to achieve the above objects, as well as others which will become apparent hereinafter, a movable closure for a generally rectangular opening in a wall, to selectively close a rectangular opening having a predetermined width and predetermined length, comprises two spaced generally parallel portions at two opposing sides of the rectangular opening. A closure member is provided having a length at least equal to said predetermined length and being movable between an open condition, at least partially exposing the rectangular opening, and a closed condition to cover the rectangular opening. Said closure member has a width selected to insure that the lateral ends of said closure member are guided by said parallel portions when the closure is moved between said open and closed conditions of said closure member. Locking means is provided for selectively locking and fixing the lateral ends of said closure member relative to said parallel portions when said closure member is closed. In this manner, said closure member acts as a beam fixed at both lateral ends thereby minimizing the maximum deflection relative to a plane defined by the wall or parallel portions as a result of a distributed load acting on said closure member.

An overhead rolling gate in accordance with the present invention, for a generally rectangular opening in the wall, comprises a generally horizontal frame portion at the top of the rectangular opening and two generally vertical portions at the lateral sides of the rectangular opening. A shaft or spindle is mounted substantially along said horizontal frame portion for rotation about a horizontal axis. A closure member has a length at least equal to the height of the rectangular opening and is capable of being rolled up unto said shaft or spindle when in an open condition of the overhead gate and rolled down from said shaft or spindle when in an open condition of the overhead gate to cover said rectangular opening. Said closure member has width selected to ensure that the lateral ends of said closure members are guided by said vertical frame portions when the closure is rolled up unto or rolled down from said shaft or spindle. Said locking member may be of any suitable or known form, including clamping means, magnetic means, or the like.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 1 is a perspective view of an overhead rolling gate in accordance with the present invention, shown in the rolled down position to close a rectangular opening in a wall;

FIG. 2 is a schematic deflection diagram illustrating maximum deflection of a conventional rolling door closure member under wind load when the lateral ends or edges of the closure member are permitted to move relative to the lateral guides formed by the vertical frame members;

FIG. 3 is a view similar to FIG. 2, but showing a substantially reduced maximum deflection under comparable wind loads when the lateral ends or edges of the closure member are locked or secured to fix the same, in a closed condition, relative to the vertical frame members;

FIG. 4 is a cross sectional view of the overhead rolling gate shown in FIG. 1, taken along line 4—4;

FIG. 7 is a cross sectional view of the overhead rolling gate shown in FIG. 5, taken along line 7—7 to show the details of the clamping member in the un-clamped condition;

FIG. 8 is similar to FIG. 7, taken along line 8—8 in FIG. 6, but showing the clamping mechanism in the clamping condition;

FIG. 9 is a view similar to FIG. 5, but showing another embodiment of a clamping mechanism;

FIG. 12 is a cross sectional view of the overhead rolling gate shown in FIG. 10, taken along line 12—12;

FIG. 13 is similar to FIG. 12, taken along line 13—13 in FIG. 11, and showing the closure member in the clamped condition;

DESCRIPTION OF THE PREFERRED EMBODIMENTS

Figures 5, 6:
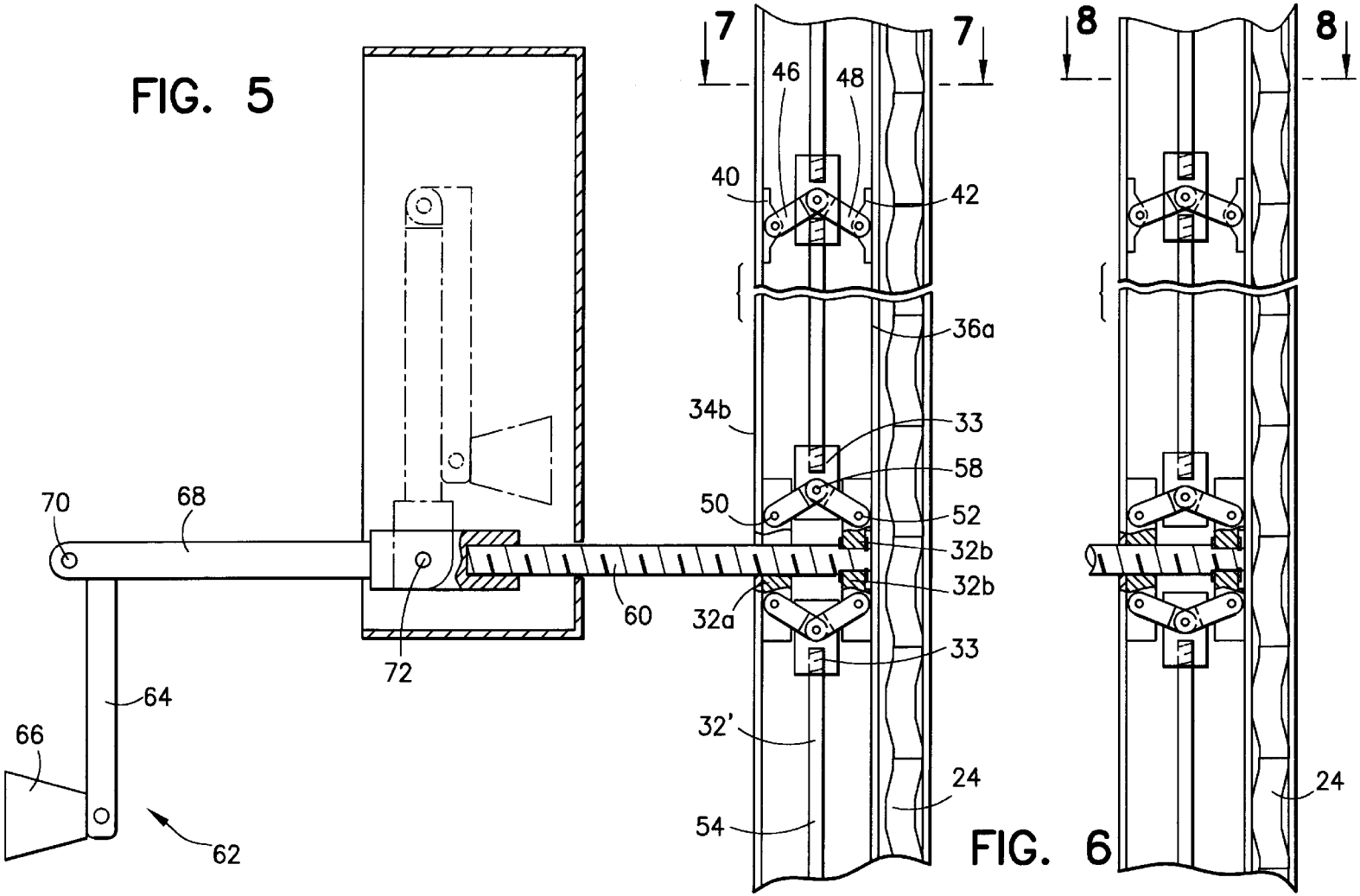
FIG. 5 is an enlarged view of the cross section shown in FIG. 4, but showing details of the clamping mechanism for selectively clamping the closure member within the vertical frame portions, shown in the un-clamped condition.
FIG. 6 is similar to FIG. 5, but showing a portion of the clamping mechanism when clamping the closure member.

Referring now specifically to the Figures, in which the identical or similar parts are designated by the same reference numeral throughout, and first referring to FIG. 1, the overhead rolling gate in accordance with the present invention is generally designated by the reference numeral 10.

The rolling gate 10 is shown as an overhead rolling door, although it will be understood that the gate in accordance with the present invention may be used as any closure in conjunction with any generally rectangular opening in a wall 12, such as a window.

A frame 14 is provided which consists of a generally horizontal frame portion 16 in the nature of a storage housing or compartment, to be described, at the upper end of the wall opening and two generally vertical lateral portions 18, 20 spaced from each other and arranged, disposed at the lateral sides of the opening in the wall. A suitable generally flat covering material defines a closure member 20 having a length at least equal to the height of the rectangular opening and a width selected to ensure that the lateral ends or edges of the closure member 22 are received within and guided by the vertical frame portions 18, 20 when the closure member 22 is rolled up or rolled down when opening and closing the overhead rolling gate.

While the closure member 22 may be formed of any suitable or conventional material used for rolling gates, in the presently preferred embodiment such closure member is formed of a plurality of slats 24 adjacent ones of which are articulated relative to each other so that the slats of the closure member can be easily rolled about a shaft or spindle, to be described. In fact, while any suitable protective material may be used for the closure member 22, it is preferred that the covering material have substantially more flexibility in one direction than in an orthogonal direction, to minimize undesired flexing of the closure member. Therefore, the closure member should be substantially more flexible along the vertical direction than along the horizontal direction, as viewed in FIG. 1. It will be clear, therefore, that closure materials other than the use of articulated slats may be used, such as corrugated metal or plastic sheets or various configurations of honeycomb materials.

An important feature of the present invention, which is more fully described hereinafter, is a locking mechanism for selectively locking and fixing the lateral ends or edges of the closure member 22, relative to the vertical frame portions 18, 20 when the closure member 22 is in the closed condition as shown in FIG. 1. By so locking the lateral ends or edges of the closure member, the closure member acts as a beam fixed at both lateral ends thereby minimizing the maximum deflection relative to a plane defined by the wall 12 or the frame 14 as a result of distributed wind loads acting on the closure member 22.

Referring to FIGS. 2 and 3, schematic deflection diagrams are illustrated to compare the relative deflections possible under wind loads with conventional rolling gates (FIG. 2) when the lateral ends or edges are not clamped or locked.

In FIG. 2, the closure member 22 is shown to have lateral ends or edges 22*a*, 22*b* captured between "floating" guides or retainer bars 26, 28, respectively. Without wind load, the door 22 is in a generally common plane with the plane of the wall 12 and the plane formed by the frame 14, indicated by the reference N. This is the normal condition of the closure member 22. However, under wind load, forces distributed along the surface of the closure member 22 causes the same to deflect inwardly to deflected condition D, at which time the opposing lateral ends or edges 22*a*, 22*b* are permitted to slide or move inwardly towards the center of the closure member 22, relative to the guides 26, 28. The maximum deflection of the center of the closure member 22 is represented by the quantity "d". Clearly, this quantity "d" will be a function of the width of the closure member 22, its flexibility or stiffness along the transverse or horizontal direction and the extent of the wind load. In FIG. 3, a similar diagrammatic deflection diagram is shown for the present invention. Here, the guides or retainer bars 26, 28 of FIG. 2 are replaced with modified guides 26', 28', which include locking means (not shown) for selectively locking and fixing the lateral ends of the closure member 22 relative to the vertical frame portions 18, 20 when the closure member 22 is closed. More specifically, in FIG. 3, the guides 26, 28 are so clamped against the lateral ends or edges 22*a*, 22*b*, when clamped in the closed condition, that maximum deflection d' in FIG. 3 for deflected condition D' is considerably less than the maximum deflection d in FIG. 2 when the lateral ends or edges are free to move in response to wind loads. The reason for this dramatic improvement can be explained by using the analytical relationships for static loading conditions of beams. Thus, for example, for a beam, in which the free ends are free to move, as with conventional rolling gates, the maximum deflection can be represented as follows:

$$\Delta\max\ (\text{at center}) = \frac{5\,wl^4}{384\,EI} \tag{1}$$

where:

w is equal to the width of the beam;

l is equal to the length of the beam;

I is the moment of inertia; and

E is the elasticity of the beam material

On the other hand, for a beam fixed at both ends, as with the present invention in which the closure member 22 has its lateral ends or edges clamped or fixed, the maximum deflection under uniformly distributed loads is as follows:

$$\Delta\max\ (\text{at center}) = \frac{wl^4}{384\,EI} \tag{2}$$

The above relationships are from the "Manual of Steel Construction", Sixth Edition, American Institute of Steel Construction, Inc., New York 1963. By comparing formulas 1 and 2 above, it is clear that the improvement in FIG. 3 as compared to FIG. 2 is a factor of 5, so that maximum deflections at the centers using the present invention is reduced by a factor of 5. This is a considerable reduction which will make it substantially easier to comply with local zoning and building codes, particularly in areas that frequently experience storms, tornadoes and the like.

Now that the principle of the present invention has been explained, a number of different embodiments will be described for achieving the clamping or fixing of the lateral ends or edges 22*a*, 22*b* as suggested in FIG. 3 by the clamping guides 26', 28'.

Referring to FIG. 4, a rotating shaft or spindle 30 is shown mounted substantially along the horizontal frame portion or housing 16 for rotation about a horizontal axis. As with conventional rolling gates, the closure member 22 is capable of being rolled up unto the shaft or spindle 30 when in an open condition of the overhead gate and rolled down from the shaft or spindle to a closed position of the overhead gate to cover the rectangular opening. The shaft or spindle 30 is of conventional design and may be actuated by any known or suitable known means.

Also in FIG. 4, there is illustrated details of an expanding member which forms the clamping mechanism for selectively locking or fixing the lateral ends or edges 22*a*, 22*b* of the closure member 22. Also referring to FIGS. 5–8, and initially referring to FIG. 7, in one form of the clamping mechanism each of the vertical frame portions 18, 20 is formed of an elongate U-shaped channel or guide 34 which is open in a direction facing the other of the vertical frame portions. Each channel 34 has opposing front and rear wall portions 34*a*, 34*b* respectively, joined by a transverse connecting wall portion 34*c*. The lateral edge or end 22*b* of the closure member 22 is received through the opening of the U-shaped channel or guide 34 and is positioned proximate to one of the wall portions 34*a*, 34*b*. In the embodiment illustrated in FIG. 7, the lateral end 22*b* of the slat 24 is shown proximate to the front or wall portion 34*a*. However, for reasons which will become evident for the description that follows, the lateral and 22*b* can also be positioned proximate to or adjacent to the rear wall portion 34*b*, in which case the clamping mechanism would be modified, in essence, to substantially provide a mirror image of what is shown and will be described.

The locking means or clamping guides 26', 28' of FIG. 3 is in the form of a force applying mechanism for selectively applying forces to each of the lateral ends 22*a*, 22*b* in the direction of the wall portion 34*a*, 34*b* to which the lateral end or edge is in closest proximity to. In the embodiment illustrated in FIG. 7, the force applying mechanism selectively applies a force in the direction F, as indicated by the arrow in FIG. 7, to urge or force the lateral end or edge 22*b* against the front wall potion 34*a* sufficient to rigidly clamp the lateral edge 22*b* against movement relative to the associated vertical frame portion 20.

It is pointed out, in relation to the description of the previous paragraph, that while a U-shaped beam or guide 34 is shown, for example, in FIG. 7, there is no need that a U-shaped beam or guide be used. It will be clear to those skilled in the art that the advantages and objects of the present invention can be achieved by merely applying a force F on the lateral end or edge 22*b* as long as there is a wall or member on the other side of the slat 24 which can counteract the force F and which results in a clamping action on the lateral edge. Theoretically, therefore, as long as the force F can be selectively applied to the lateral ends or edges of the slat 24, it will be sufficient to provide only the front portions 34*a* and omit the rear portion 34*b* or the connecting portion 34*c*.

The expanding member 32 of FIGS. 4–8 includes a plurality of control blocks 33 which are spaced from each other along the height of the vertical frame portions 18, 20, although the number of such control blocks 33 and/or their spacing is not critical. In the embodiment illustrated in FIG. 4, there is one central block 33' and two spaced central blocks 33 above and two below the central block 33'. The blocks 33, 33' are positioned between the slats 24 and the rear portion 34*b*.

Part of the expanding member 32 is an L-shaped beam 36 which includes a first portion 36*a* which is generally parallel to the front and rear wall portions 34*a*, 34*b* and a transverse portion 36*b* which is generally parallel to the transverse connection wall portion 34*c*. In the unlocked position of the closure member 22, the wall portion 36*a* is spaced from the slats 24 so as to create a space or clearance 38*b* (FIG. 7), which allows the slats 24 of the closure member 22 to move upwardly or downwardly within the confines of the frame 14.

The specific expanding member 32 shown in FIGS. 4–8 includes brackets 40 fixedly mounted on the rear wall portion 34*b* and opposing brackets 42 secured to the wall portion 36*a* of the L-shaped beam 36. The expanding elements 44 include a pair of levers or links 46 and 48 which are pivotally secured to the brackets 40, 42 by pins 50, 52 and to an associated central block 33 by means of central pivot pins 53 (FIG. 5). The central blocks 33' (FIG. 5) formed of blocks 32*a*, 32*b* are respectively mounted on the rear wall portion 34*b* and wall portion 36*a*. The blocks 32*a*, 32*b* may be oppositely threaded. However, in the embodiment shown, the block 32*b* (FIG. 5) forms a sleeve bearing 32*b* which captures and axially locks the free end of the screw 60. By turning the crank handle 64 the screw 60 moves the block 32*a* relative to the block 32*b* to either move these towards each other (FIG. 5) or away from each other (FIG. 6). This will be clear that separation of the wall portions 34*b* and 36*a* will cause the links 46, 48 to pivot and become more in-line or horizontal (FIG. 6), while bringing such wall portions together causes such links to move in opposite directions (FIG. 5) However, movement of the links also moves the central blocks 33 are coupled to the control rods 32', it will also be clear that the central blocks 32' will follow the central blocks 33' and the corresponding links associated with the blocks 33 and the blocks 33'. It will be evident, therefore, that the described construction makes it possible to apply more uniform clamping forces along the height of the vertical frame portions 18, 20 by means of a single force applying means, namely the crank 62 and the expanding member 32.

Figure 11:
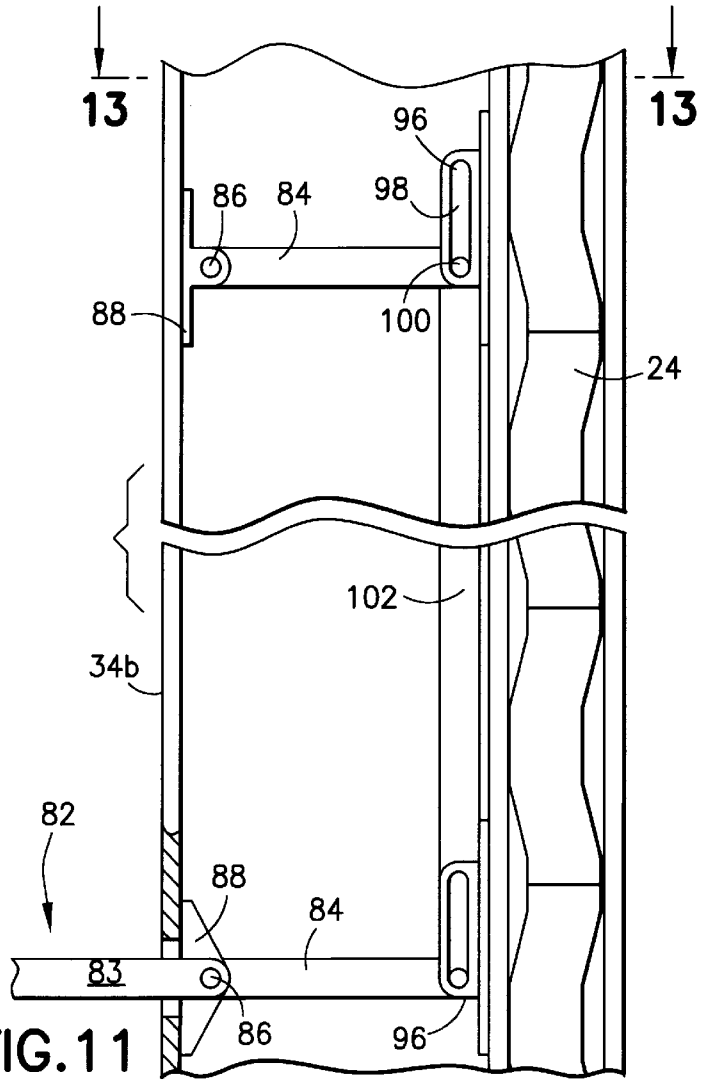
FIG. 11 is similar to FIG. 10, but showing the alternate clamping mechanism of FIG. 9 in the clamping condition.
Figure 10:
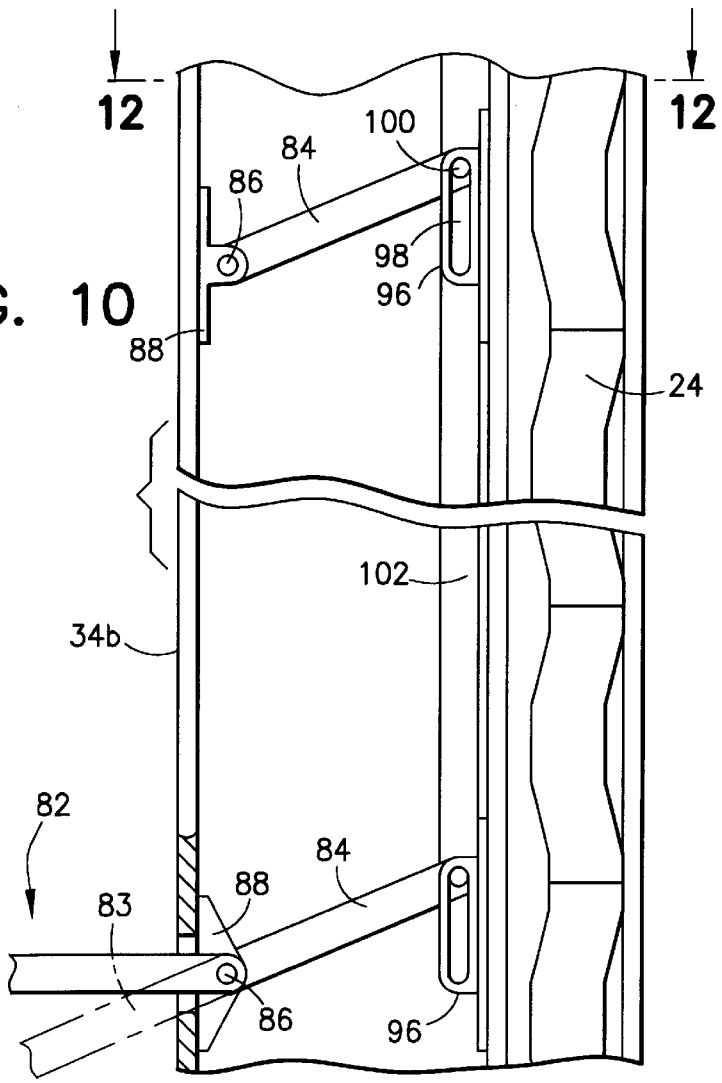
FIG. 10 is similar to FIG. 5, but showing an enlarged view of the clamping mechanism of FIG. 9 in the non-clamping condition.

Referring to FIGS. 9–13, a U-shaped beam member 90 has spaced, parallel wall portions 90*a*, 90*b*, and a connecting wall portion 90*c*, which corresponds to wall portion 36*a* in FIG. 7. The wall portion 90*a* is provided with over-sized holes or slots 94 to allow rivets 92 to pass through the U-shaped channel or guide 34, and specifically the transverse connecting wall portion 34*c*, and the wall portion 90*a*. The slots or holes 94 are such as to provide clearances or spaces 94'. Slotted guides 96 are mounted on the wall portion 90*c*, as shown in FIG. 10. A lever 82 has an actuating arm portion 83 extending beyond the vertical frame member 20 as shown and a lever arm 84 arranged between the rear portion 34*b* and the movable portion 90*c*. The lever 82 is slidably mounted within a slot 98 by means of a pin 100 fixedly mounted on lever 82. The length of the lever arm 84 is such that when it is horizontally disposed, as shown in FIG. 11, it forces the wall portion 90*c* of the U-shaped beam 90 into contact with the lateral ends or edges of the slats. In FIG. 10, the lever is pivoted in a counterclockwise direction, with the pin 100 at the upper end of the vertical slot 98. In this condition, the lever 82 draws the wall portion 90*c* towards the wall portion 34*b* as shown in FIG. 10. When clamping is desired, the lever 82 may be manually raised or rotated in a clockwise direction about pin 86 so as to rotate the lever arm 84 on which the pin 100 is mounted, the pin thereby being lowered, bringing all of the pins 100 to the lower ends of the slots 98, which brackets are fixedly mounted on the wall portion 90*c*. As in the previous embodiment, therefore, the manual movement, namely rotation of the actuating arm 82 in a clockwise direction causes clamping forces to be applied along the entire vertical length of the vertical bar 102, and releases those portions of the bar where the support lever 88 is provided.

Figure 15:
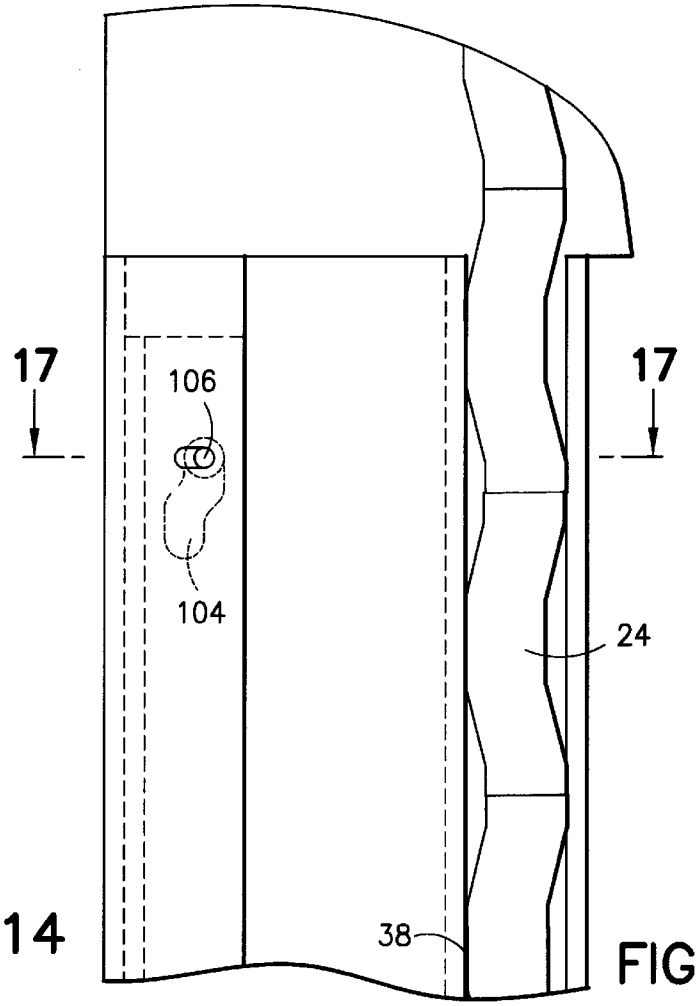
FIG. 15 is similar to FIG. 14, but showing the clamping mechanism of FIG. 14 in the clamped condition.
Figure 14:
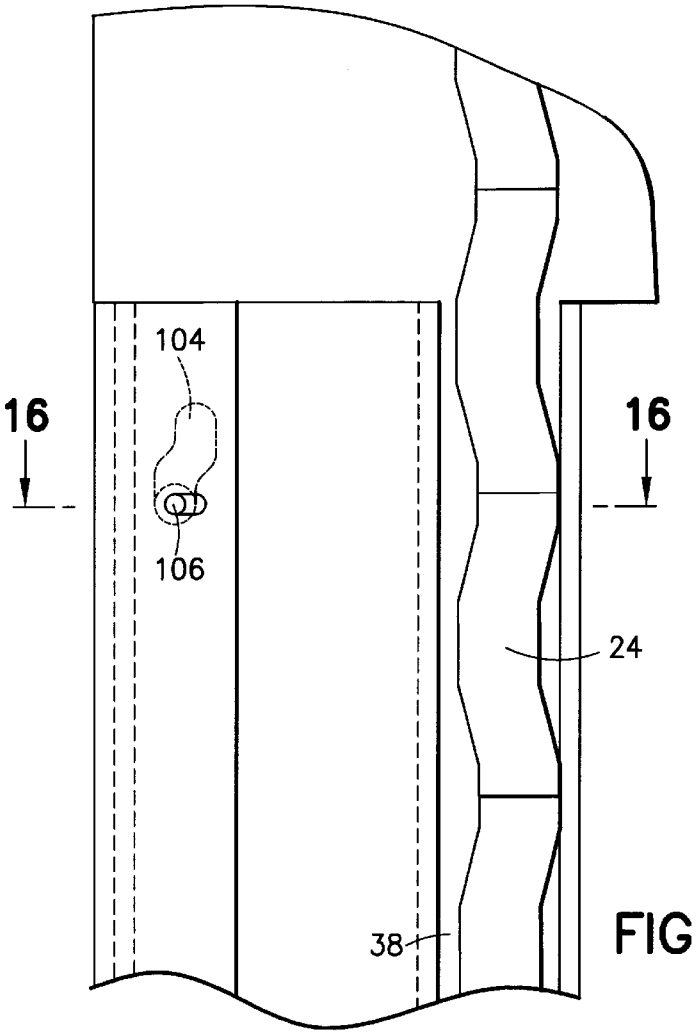
FIG. 14 is similar to FIG. 5, but illustrating still another embodiment of the invention, in which the clamping mechanism utilizes a cam slot and a cam pin guided in the cam slot, shown in the un-clamped condition.
Figure 16:
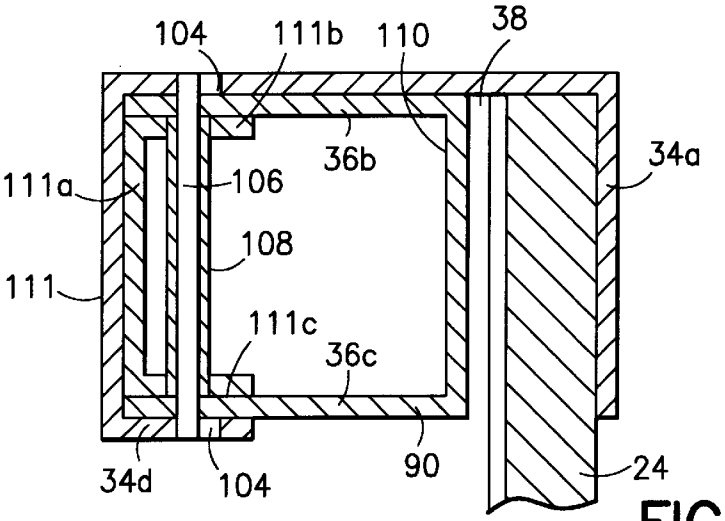
FIG. 16 is a cross sectional view of the overhead rolling gate shown in FIG. 14, taken along line 16—16.

Referring to FIGS. 14–17, a similar construction is shown as illustrated in FIGS. 9–13, wherein cam slots 103 are provided within wall portion 34*c* and an additional wall portion 34*d* of the U-shaped beam or guide 34, which is substantially parallel to the connecting wall portion 34*c*. The cam slots 104 are as shown in FIG. 14. A U-shaped member 110, which is equivalent to the L-shaped beam 36 of FIG. 7, except that it is provided with an additional wall portion 36*c* which is parallel to wall portion 36*b*. Pin 106 extends transversely through various wall portions 34*c*, 36*b*, 36*c* and 34*d* as shown in FIG. 16. With the U-shaped member 106 as shown, in a lower position thereof relative to the vertical beam or guide 34, the pin 106, in the form of a cam follower, is situated in the lower end of S-shaped cam slot 104. When the U-shaped member 110 is raised, by any suitable means, the pin 110 rides within the cam slot 104 and assumes the upper position, as shown in FIG. 15. By virtue of the shape of the cam slots, the U-shaped inner member 110 is urged forwardly towards the central portion 34*a* and then into contact with the lateral ends or edges of the slot 24, clamping the slot 24 as with the previous embodiments.

Figure 17:
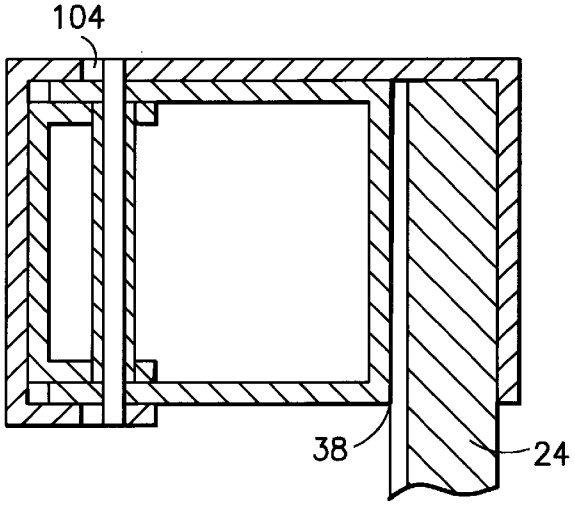
FIG. 17 is similar to FIG. 16, but taken along line 17—17 in FIG. 15 showing the clamped condition of the gate.

Referring to FIG. 16, the movable cam pin 106 is shown mounted on a vertically moving bar or beam 111, which has a central portion 111*a* and two right-angle portions 111*b* and 111*c* as shown. The opposing portions 111*b* and 111*c* include a bar for supporting a sleeve 108 through which the cam pin 106 is journaled. The free ends of the cam pin 106 are received within the cam slots 104 which is shown in FIGS. 14 and 15. It is clear that vertical movements of the bar or beam 111, carrying cam pin 106, will cause the cam pin to move forwardly or rearwardly with upward or downward movements, respectively. Since the ends of the cam pin 106 also extend through holes of the U-shaped member 110, namely the arms of 36*b*, 36*c* thereof as shown in FIG. 16, the U-shaped member 110 will assure the forward and rearward movements of the cam pin 106. Therefore, as suggested, the clamp slot 24 and the cam pin 106 is moved upwardly to the position shown in FIG. 15, while to release the slot 24 the cam pin 106 is moved downwardly to the position shown in FIG. 14. FIGS. 16 and 17 show the corresponding positions in FIGS. 14 and 15. The specific method or means for raising and lowering the vertically movable bar/beam 111 is not critical to the purposes of the present invention and any suitable or conventional means, such as hydraulic, electrical, pneumatic means and the like, may be used.

Figure 19:
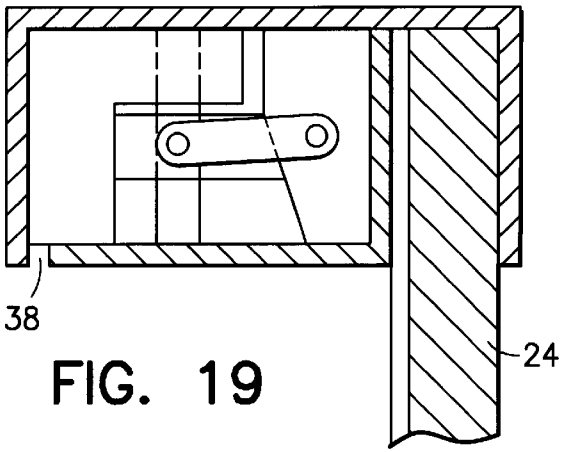
FIGS. 18 and 19 are similar to FIGS. 16 and 17, but illustrating still another embodiment of the invention.
Figure 18:
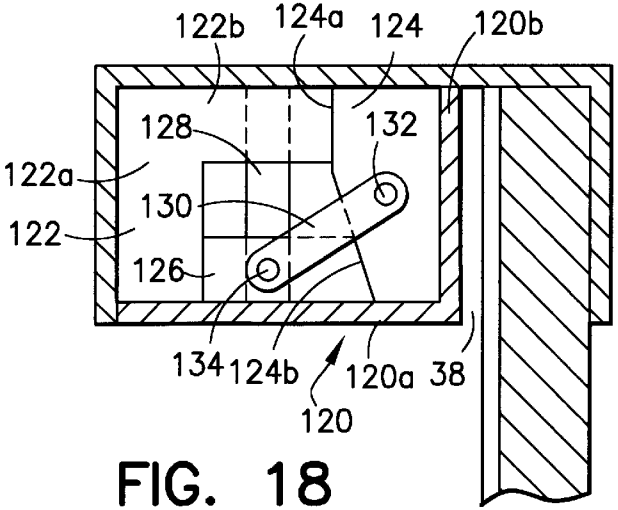

In FIGS. 18 and 19, an alternate method for clamping slot 24 is illustrated in which an L-shaped member 122 is provided with portions 122*a* generally parallel to the slot 24 and a portion 122*b* generally normal to the slot 24. Second member 124, in the form of a block, has a surface 124*a* generally parallel to the slot 24 and an inclined surface 124*b* as shown. A beam 120 having an L-shaped cross-section as shown in FIGS. 18 and 19 includes a first portion 120*a* and a clamping 124*b*. A further member 126 in the form of a block has an inclined surface 126*a* which abuts against the inclined surface 124*a* and is mounted for slidable movement along a shaft 128, which may be in the form of a screw threadedly meshed with the block 126. The block 126 is movable along a direction parallel to the axis of a shaft or screw 128, as suggested in FIGS. 18 and 19. A link 130 is pivotally connected to the members 124, 126 by means of pivot pins 132, 134. With this arrangement, it is clear that movement of the block 126 towards the portion 122*b*, by any suitable means, causes the inclined surfaces 124*b*, 126*b* to slidably engage each other while the link rotates in a clockwise direction (as viewed in FIGS. 18 and 19). The effect of these motions is to force the block 124 and the portion 124*b* towards the slot 24 to abut against clamp the slats. Unclamping or releasing of the slats may be achieved by reversing the motions or movements aforementioned. As suggested, the member 128 may be a screw that is rotated by any drive means, such as a suitable motor, to selectively move the member or block 126 towards the portion 122*d* (as shown in FIG. 19) or away from portion 122*b* (as shown in FIG. 18).

Figure 21:
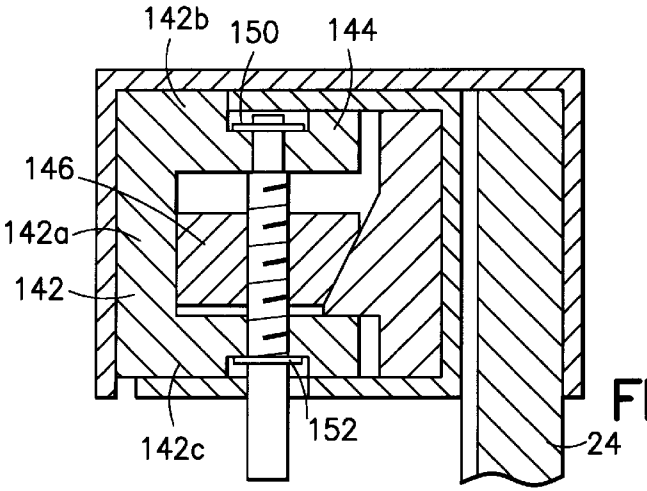
FIGS. 20 and 21 are similar to FIGS. 18 and 19, but showing yet another embodiment of the present invention.
Figure 20:
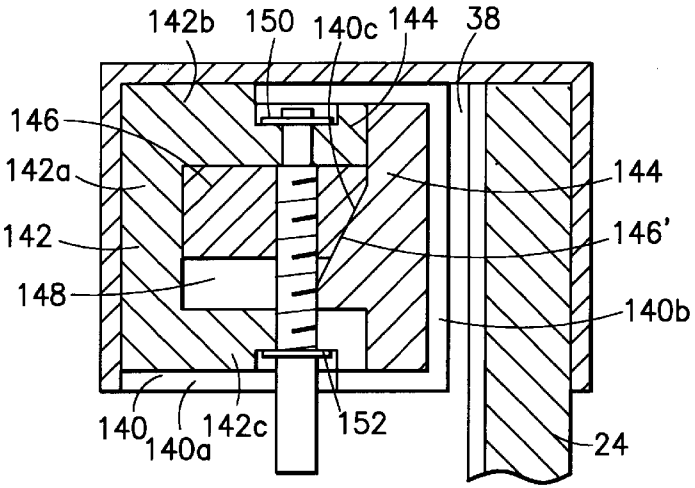

In FIGS. 20 and 21, a further embodiment of the invention is illustrated in which a member 142 having a central portion 142*a* and two right-angle portions 142*b*, 142*c* is positioned oppositely to a second member 144 which is provided with an inclined surface 144. Provided within the space between the portions 142*b*, 142*c* there is provided a movable member 146, similar to the member 126 in FIG. 18. The member 146 has an inclined surface 146' which conforms to the angle of the inclined surface 144' as shown. However, it will be appreciated that the inclined angles in FIGS. 18 and 20 are opposite so that the clamping portion 140*b* is in the unclamped position when the member 146 is approximate to the portion 142*b* (FIG. 20), while the slots are clamped, when the member is moved downwardly to portion 142*c* (FIG. 21). The position of the block 146 may be controlled by screw 148 which is threadedly engaged with the block 146, the screw being retainable in one direction or another by its axis by any suitable conventional drive means.

Figure 23:
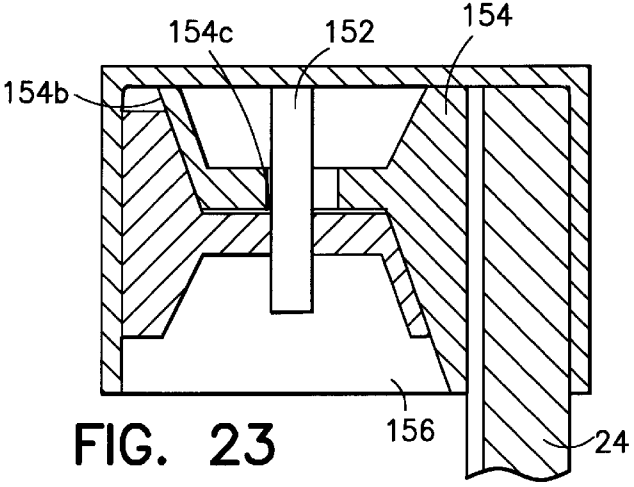
FIGS. 22 and 23 are similar to FIGS. 20 and 21, but illustrating an additional embodiment of the present invention.
Figure 22:
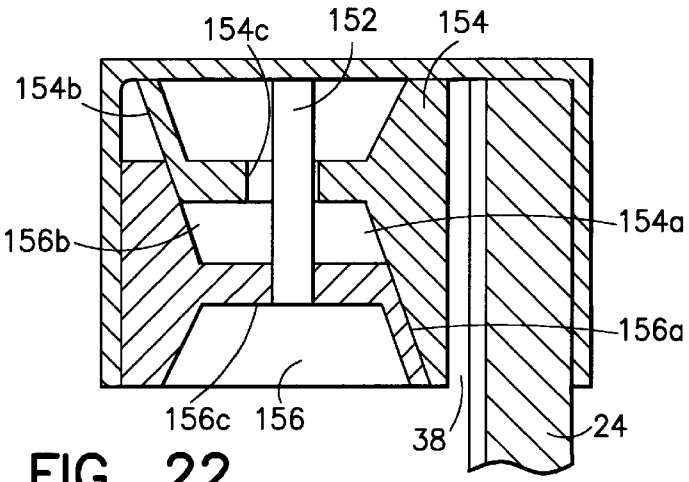

Double inclined surfaces are shown in FIGS. 22 and 23, illustrating further embodiments of the present invention. Here, a first member 154, which serves as the clamping member, includes a first inclined surface 154*a* and a second inclined surface 154*b* as shown, and an enlarged opening or slot 154*c* therebetween. A second member 156 is provided with a first inclined surface 156*a*, which corresponds to the inclined surface 154*a*, and a second inclined surface 156*b*, which corresponds to the inclined surface 154*b*. A hole 156*c* is provided between the inclined surfaces of the member 156. By separating the members 154, 156, as shown in FIG. 22, the clamping portion 154 of clamping member is moved away from the slat 24. However, when the movable member 156 is moved towards the member 154, as shown in FIG. 23, the corresponding inclined surfaces 154*a*, 156*a* and 154*b*, 156*b* slide against each other as shown, causing clamping member 154 to move towards the slat 24 and clamp the same. Any suitable conventional means may be used to move the movable member 156 between the positions shown in FIGS. 22 and 23.

Figure 24:
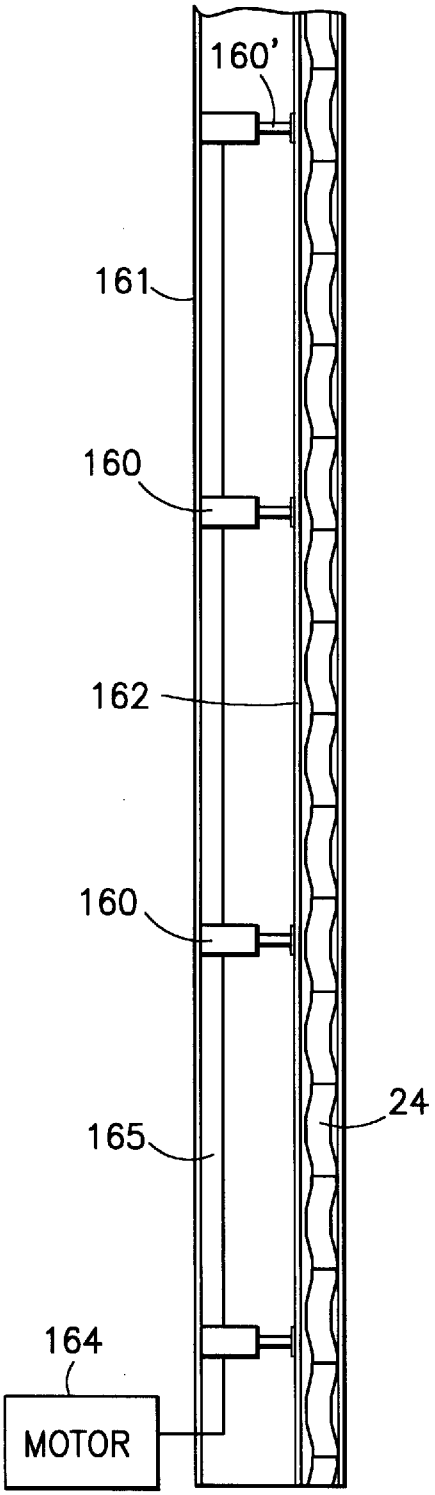
FIGS. 24 and 25 are similar to FIGS. 5 and 6, but illustrating a yet further embodiment of the present invention, in which an external actuator may be used to selectively move the clamping member within the vertical frame portions.
Figure 25:
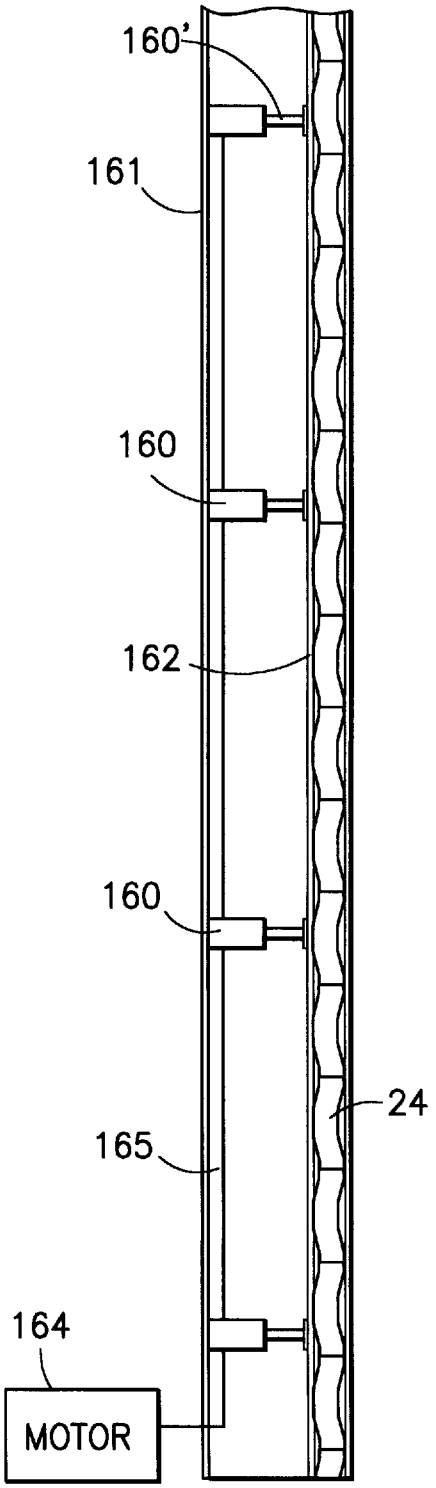

In FIGS. 24 and 25, extendable members 160 are spaced from each other and supported on a suitable support structure, such as a vertical beam 161. A clamping of a vertical clamping member, such as a vertical plate, beam or wall 162 is mounted on the extendable portions 165 of the extendable members 160. Extendable member 160 may be hydraulic or pneumatic cylinders or may be electrical solenoids. In FIG. 24, the extendable members 160 are shown in their retracted positions, moving the clamping member 152 away from the slat 24, towards the slats and away from the slats is not critical to the purpose of the current invention, any such conventional or known means may be used. In the illustrated embodiment, a hydraulic motor 164 is used which pumps or releases the pressure on hydraulic fluid within the hydraulic line 165. However, other means may be used. In FIG. 25, the extendable members are shown in their extendable members are shown in their extendable positions, thereby moving the clamping all or member 162 towards the right, as viewed in FIG. 25, for clamping the slat 24.

While we have shown and described the preferred embodiments of the invention, it will be readily apparent to those skilled in the art that there are changes, modifications and improvements which may be made therein without departing from the spirit and scope thereof as previously defined and envisioned and as may hereinafter be claimed. Thus while the preferred embodiments have been exemplified by vertical closures, specifically overhead rolling gates, the invention can also be incorporated into other closure structures acting in different planes such as inclined or horizontal planes. Such application can include closures for inclined openings such as windows, and inclined or horizontal closures such as protective shields for inclined roofs and pool covers intended to resist snow loads.

Also, while the presently preferred embodiment describe a rolling-type closure member which rolls about a spindle, it will also be evident that such closures need not be of a roll-up type. Such closures may be in the form of a rigid or semi-rigid planar wall which simply slides or moves relative to the frame portion that guide the closure member by moving substantially in the plane defined by such guides. Whether the closure member remains in a fully extended or flat condition as it moves between an open and closed conditions thereof, or whether the closure member rolls up about a spindle is not critical for purposes of this invention. The important feature is that the closure member be guided by the spaced parallel frame or support portions and that locking means be provided to selectively locking the lateral ends or edges of the closure member in a closed condition of the closure member to insure that the closure member acts as a beam fixed at both lateral ends. Therefore, the orientation of the plane in which the closure member acts or the specific manner in which it is moved from one condition to the next is not critical and any reasonable variations may be used with different degrees of advantage.

We claim:

1. Overhead rolling gate for a generally rectangular opening in a wall comprising a generally horizontal frame portion at the top of the rectangular opening and two generally vertical portions at the lateral sides of the rectangular opening each of said vertical portions having guide means extending along at least a portion thereof and being parallel therewith; a shaft mounted substantially along said horizontal frame portion for rotation about a horizontal axis; a closure member having a length at least equal to the height of the rectangular opening and being capable of being rolled up onto said shaft when in an open condition of the overhead gate and rolled down from said shaft to a closed position of the overhead gate to cover said rectangular opening, said closure member having a width selected to insure that the lateral edges of said closure member are guided by said guide means when the closure is rolled up unto or rolled down from said shaft; and locking means for selectively locking and fixing the lateral edges of said closure member relative to said guide means when said closure member is closed up to anticipated wind loads of approximately 103 pounds per square foot, whereby said closure member acts as a beam fixed at both lateral ends thereby minimizing the maximum deflection relative to a plane defined by the wall or frame as a result of distributed anticipated wind loads acting on said closure member.

2. Overhead rolling gate as defined in claim 1, wherein each said two substantially vertical frame portions comprises an elongate wall portion, said lateral edges of said closure member being positioned proximate to associated ones of said wall portions, said locking means comprising force applying means for selectively applying forces to each of said lateral edges in the direction of said one of said front and rear wall portions sufficient to rigidly clamp the same against movement relative to the associated wall portions.

3. Overhead rolling gate as defined in claim 1, wherein said closure member is formed of a plurality of horizontal slats adjacent ones of which are articulated relative to each other so that the slats of the closure member can be rolled about said shaft or spindle.

4. Overhead rolling gate as defined in claim 1, wherein each of said two guide means portions comprises an elongate channel having a substantially U-shaped cross-section and open in a direction facing the other of said guide means, each channel having opposing front and rear wall portions joined by a transverse connecting wall portion, said lateral edges of said closure member being received through the openings in said elongate channels and being positioned proximate to one of said front and rear wall portions, said locking means comprising force-applying means for selectively applying forces to each of said lateral edges in the direction of said one of said front and rear wall portions sufficient to rigidly clamp the same against movement relative to the associated vertical frame portions, wherein said force-applying means includes an electrical drive.

5. Overhead rolling gate as defined in claim 4, wherein said force applying means comprises an expansion mechanism, between the other of said front and rear wall portions and said lateral edges, which can be selectively expanded to apply a clamping force on said lateral edges and retracted to remove said clamping force and permit said closure member to be moved relative to said vertical frame portions.

6. Overhead rolling gate as defined in claim 5, wherein said expansion mechanism comprises an elongate beam substantially parallel to said front and rear wall portions and disposed between said lateral edges and the other of said front and rear wall portions, and drive means for selectively moving said elongate beam into abutment against or away from said lateral edges.

7. Overhead rolling gate as defined in claim 6, wherein said drive means comprises a plurality of butterfly expansion assemblies spaced from each other along the lengths of said vertical frame portions, each assembly having a pair of levers having ends pivoted on said other of said front and rear wall portions and also on central blocks which are linked to each other by means of central rods which transfer common movements to each other; and a crank mechanism coupled to one of said central blocks for moving the associated butterfly expansion mechanism to clamping or releasing positions.

8. Overhead rolling gate as defined in claim 6, wherein said drive means comprises a plurality of support levers pivotally mounted on the other of said front and rear wall portions, each support lever having a length greater than the spacing between said other of said front and rear wall portions and said lateral edges, and an actuating arm coupled to one of said support levers, whereby movement of said actuating arm causes said support levers to urge said elongate beam against said lateral edges.

9. Overhead rolling gate as defined in claim 8, wherein said elongate beam includes slotted brackets; and said support levers include pins captured within said slotted member.

10. Overhead rolling gate as defined in claim 4, wherein said electrical drive includes a motor.

11. Overhead rolling gate as defined in claim 1, wherein said locking means includes a cam mechanism for moving first and second cam members relative to each other within said vertical portions to thereby separate said cam members relative to each other and applying clamping forces to said lateral edges.

12. Overhead rolling gate as defined in claim 11, wherein said cam members include a first member with a cam slot and a second member with a pin that is captured and is required to travel within said cam slot.

13. Overhead rolling gate as defined in claim 11, wherein said cam members are driven by screw drives.

14. Overhead rolling gate as defined in claim 11, wherein said first and second members are coupled by a link.

15. Overhead rolling gate as defined in claim 1, wherein said locking means includes a hydraulically actuated lock.

16. Overhead rolling gate as defined in claim 1, wherein said locking means includes a magnetically actuated lock.

17. Overhead rolling gate as defined in claim 1, wherein said locking means includes a mechanically actuated lock.

18. Overhead rolling gate as defined in claim 1, wherein said locking means includes a pneumatically actuated lock.

19. A movable closure for a generally rectangular opening in a wall, the rectangular opening having a predetermined width and predetermined length, the closure comprising two spaced generally parallel guide portions at two opposing sides of the rectangular opening; a closure member having a length at least equal to said predetermined length and being movable between an open condition at least partially exposing the rectangular opening and a closed condition to cover the rectangular opening, said closure member having a width selected to insure that the lateral edges of said closure member are guided by said parallel, portions when the closure is moved between said open and closed conditions of said closure member; and locking means for selectively locking and fixing the lateral edges of said closure member relative to said parallel guide portions when said closure member is closed up to anticipated wind loads of approximately 103 pounds per square foot, whereby said closure member acts as a beam fixed at both lateral ends thereby minimizing the maximum deflection relative to a plane defined by the wall or parallel portions as a result of a distributed anticipated wind loads acting on said closure member.

20. Overhead rolling gate for a generally rectangular opening in a wall comprising a generally horizontal frame portion at the top of the rectangular opening and two generally vertical portions at the lateral sides of the rectangular opening; a shaft mounted substantially along said horizontal frame portion for rotation about a horizontal axis; a closure member having a length at least equal to the height of the rectangular opening and being capable of being rolled up onto said shaft when in an open condition of the overhead gate and rolled down from said shaft to a closed position of the overhead gate to cover said rectangular opening, said closure member having a width selected to insure that the lateral edges of said closure member are guided by said vertical frame portions when the closure is rolled up unto or rolled down from said shaft or spindle; and locking means for selectively locking and fixing only the lateral edges of said closure member relative to said vertical portions when said closure member is closed, whereby said closure member acts as a beam fixed at both lateral ends thereby minimizing the maximum deflection relative to a plane defined by the wall or frame as a result of distributed wind loads acting on said closure member without the need to secure portions of said closure member at points intermediate said lateral ends, wherein each of said two substantially vertical frame portions comprises an elongate channel having a substantially U-shaped cross section and open in a direction facing the other of said vertical frame portions, each channel having opposing front and rear wall portions joined by a transverse connecting wall portion, said lateral ends of said closure member being received through the openings in said elongate channels and being positioned between to one of said front and rear wall portions and said locking means sufficiently to rigidly clamp the same against movement relative to the associated vertical frame portions, and wherein said locking mean is actuated by an electrical drive.

* * * * *